United States Patent [19]

Bothwell

[11] Patent Number: 4,887,565

[45] Date of Patent: Dec. 19, 1989

[54] INTERNAL COMBUSTION ENGINE

[76] Inventor: Peter W. Bothwell, "Meoncote" 114 Shipston Road, Stratford upon Avon, Warwickshire, United Kingdom

[21] Appl. No.: 263,276

[22] Filed: Oct. 27, 1988

[51] Int. Cl.[4] ..... F01L 1/30

[52] U.S. Cl. ..... 123/90.26

[58] Field of Search ..... 123/90.24, 90.26

[56] References Cited

U.S. PATENT DOCUMENTS

| | | | |
|---|---|---|---|
| 1,493,419 | 5/1924 | Asbury | 123/90.26 |
| 1,937,152 | 11/1933 | Jünk | 123/90.26 |
| 4,036,185 | 7/1977 | Key | 123/90.26 |
| 4,711,202 | 12/1987 | Baker | 123/90.26 |

FOREIGN PATENT DOCUMENTS

| | | | |
|---|---|---|---|
| 240446 | 7/1987 | European Pat. Off. . | |
| 624260 | 3/1926 | France . | |
| 561030 | 4/1957 | Italy | 123/90.26 |
| 783803 | 10/1957 | United Kingdom . | |
| 1125263 | 8/1968 | United Kingdom . | |
| 2166799 | 5/1986 | United Kingdom . | |

OTHER PUBLICATIONS

"Motorrad" Article, pp. 1–4; vol. 16; Jul. 1985.

*Primary Examiner*—David A. Okonsky
*Assistant Examiner*—Weilun Lo
*Attorney, Agent, or Firm*—Parmelee, Miller, Welsh & Kratz

[57] ABSTRACT

A poppet valve in an internal combustion engine is moved in both the opening and closing directions by a follower coupled with the valve and defining an internal cam-track. There extends through an aperture defined by the follower a camshaft having a cam which includes a pair of diammetrically opposite contact portions which run on the cam track and cause the follower to reciprocate.

6 Claims, 3 Drawing Sheets

INTERNAL COMBUSTION ENGINE

BACKGROUND TO THE INVENTION

The present invention relates to an internal combustion engine having one or more reciprocating valves. It is common to provide springs for urging such valves to the closed position and to provide a cam mechanism for opening the valves. The disadvantages of these known arrangements are well known.

There have been proposed alternative arrangements for operating reciprocating valves which do not rely upon biasing of the valves by means of springs. An example of such a proposal is disclosed in an article in the Journal "Motor Cycle" issued 1st May 1958. This article describes an arrangement proposed by one R. Gardner and is referred to herein as the "Gardner arrangement". In the Gardner arrangement, there is provided for each valve a rocker mounted adjacent to one of its ends for rocking about a fixed pivot axis and connected adjacent to its opposite end with a stem of the valve. An intermediate portion of the rocker is of annular form and defines an internal cam track. The cam track is engaged at diammetrically opposite positions by two rollers which are moved around a circular path, centered on an axis of a camshaft. The cam track is non-circular so that the rocker is caused to rock about its pivot axis as the rollers move around the camshaft axis.

A relatively large space must be provided in the engine to accommodate the rockers of the Gardner arrangement. This limits the choice in the disposition of other parts of the engine, for example in the routing of inlet ducts and exhaust ducts. Each rocker inevitably possesses considerable mass and so quite large forces have to be exerted to overcome the inertia of the rocker. A further disadvantage of the Gardner arrangement is that the motion of the rocker relative to the camshaft axis is along an arcuate path centered on the pivot axis. The rocker executes angular motion relative to the corresponding valve.

SUMMARY OF THE INVENTION

According to the present invention, there is provided in an internal combustion engine having at least one valve which is guided for reciprocation along a rectilinear path, operating means for moving the valve in opposite directions along the path, the operating means comprising a follower, guide means for guiding the follower for reciprocation along a rectilinear path which is an extension of the path along which the valve reciprocates, coupling means for coupling the follower with the valve, a non-circular, endless track formed in the follower and facing towards an axis (called herein the cam axis), which axis is transverse to the path of the follower and a cam supported for rotation around said axis and having a plurality of contact portions which run on the track and cause reciprocation of the follower relative to the cam axis when the cam rotates around the cam axis, the guide means restraining rotation of the follower around the cam axis.

Operating means in accordance with the present invention can be arranged to occupy a smaller space in the engine than is required to accommodate the Gardner arrangement. Furthermore, the components can be less massive than are components of the Gardner arrangement. The follower of operating means in accordance with the present invention reciprocates along a rectilinear path relative to the cam axis so that the position of the follower relative to the cam changes in a relatively simple manner.

In the preferred engine, the cam has two only contact portions, these lie at opposite sides of the cam axis, the track formed in the follower includes two opposite portions which substantially define respective arcs of a common circle and these portions are engaged by respective ones of the contact portions of the cam when the valve is held by the cam and follower in a closed position. The camshaft rotates at one quarter crankshaft speed in order that the valves will be opened and closed at the correct times.

An example of an engine embodying the present invention will now be described, with reference to the accompanying drawings, wherein:

DESCRIPTION OF THE PREFERRED EMBODIMENT

The invention may be applied to an engine arranged generally as disclosed in U.S. Pat. No. 4,697,554. That published specification discloses an engine with a number of valves each having a longitudinal axis which intersects a camshaft of the engine and there is interposed between the valve and the camshaft a reciprocating tappet which transmits an opening force from the cam to the valve. For closing the valves, there is associated with each valve a respective spring. The engine illustrated in the accompanying drawings differs from that disclosed in U.S. Pat. No. 4,697,554 primarily in respect of the operating means provided for opening and closing the valves.

Figure 1:
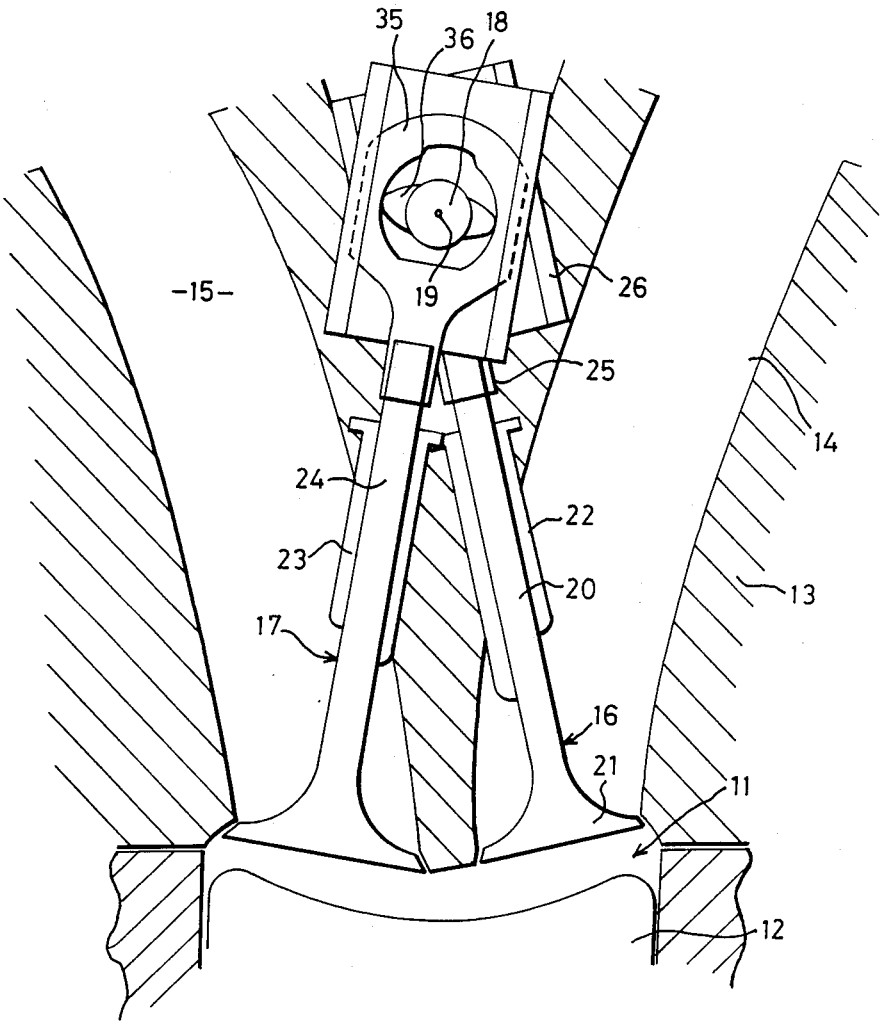
FIG. 1 illustrates diagrammatically an inlet valve and an exhaust valve associated with a common cylinder of the engine.

In FIG. 1 of the accompanying drawings, there is shown a part of a cylinder block defining a cylinder 11 in which a piston 12 reciprocates. FIG. 1 also shows a part of a cylinder head 13 which defines an inlet duct 14 communicating with the cylinder 11 at an inlet port and an exhaust duct 15 communicating with the cylinder at an exhaust port. An inlet valve 16 is provided for closing the inlet port and an exhaust valve 17 is provided for closing the exhaust port. As shown, the inlet port preferably lies in a plane which is inclined to the exhaust port, the face of the cylinder head which is presented towards the cylinder 11 being of inverted pentroof form.

The cylinder head supports a camshaft 18 for rotation about a cam axis 19 which is perpendicular to the longitudinal axis of the cylinder 11. The axis of the cylinder may intersect the axis 19 or pass near to that axis.

The inlet valve 16 comprises an elongated, rectilinear stem 20 and a head 21 at one end of the stem which, when the valve is closed, engages a seat defined by the cylinder head 13. The stem 20 of the valve is slidably mounted in a valve guide 22 which is fixed in the cylinder head 13 and which guides the valve for reciprocation along a rectilinear path between open and closed positions of the valve. This path is so inclined to the longitudinal axis of the cylinder 11 that a longitudinal axis of the valve stem 20 intersects the cam axis 19 at right angles. A further valve guide 23 is mounted in the cylinder head 13 for guiding the exhaust valve 17 for reciprocation along a rectilinear path which is so inclined to the axis of the cylinder that a longitudinal axis of the stem 24 of the exhaust valve also intersects the cam axis 19 substantially at right angles. The valve guides 22 and 23 are so positioned that the respective positions where the axes of the valve stems intersect the cam axis 19 are spaced somewhat along the cam axis.

Figure 2:
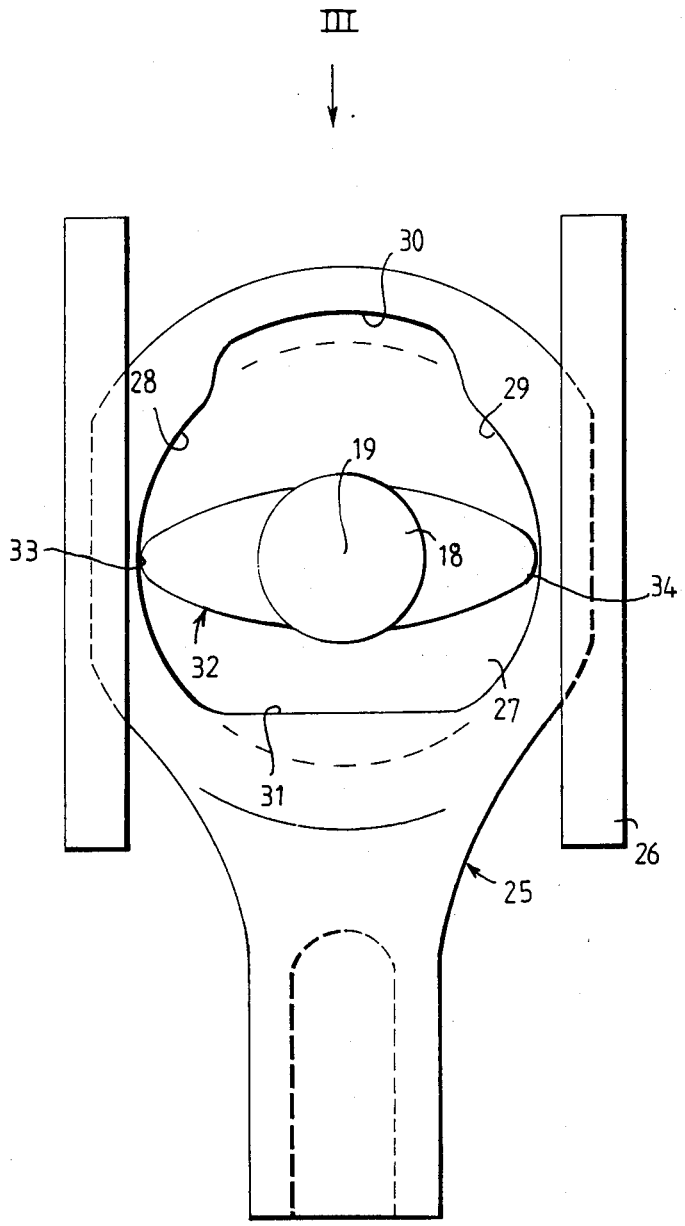
FIG. 2 shows on an enlarged scale operating means for the inlet valve of FIG. 1.
Figure 3:
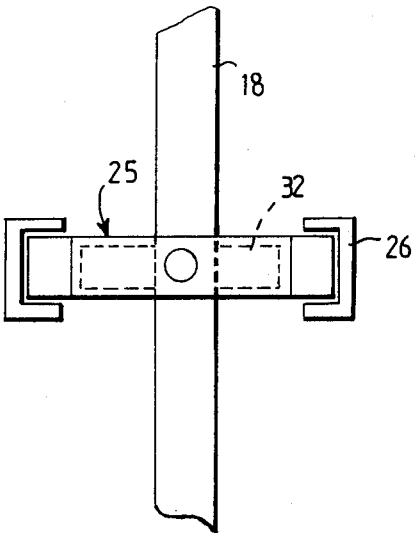
FIG. 3 illustrates the operating means, as viewed in a direction along the arrow III on FIG. 2.

There is provided for the inlet valve 16 a follower 25 which is disposed adjacent to the end of the valve stem remote from the valve head. There is mounted in the cylinder head 13 a guide 26 for guiding the follower 25 for reciprocation along a rectilinear path which is an extension of the path along which the inlet valve 16 moves. As illustrated in more detail in FIGS. 2 and 3, the guide 26 comprises a pair of opposed, rectilinear and mutually parallel guideways in which respective marginal portions of the follower are received. These marginal portions present in respective opposite directions flat surfaces which have a substantial length in a direction along the associated valve stem and co-operate with the guide 26 to restrain turning of the follower about the cam axis 19. The follower 25 is coupled with the inlet valve 16 in a known manner to restrain longitudinal movement of the valve relative to the follower.

The follower 25 defines an aperture 27 through which the cam axis 19 extends. The internal surface of the follower, which faces towards this axis, constitutes an endless track which is of non-circular form. Diammetrically opposed parts 28 and 29 define respective arcs of a circle which, in the closed position of the inlet valve, is centered on the cam axis 19. The track parts 28 and 29 are spaced from each other in a direction transverse to the direction in which the follower reciprocates. Between the portions 28 and 29, there lie opposed non-circular track portions 30 and 31. The track portion 31 lies nearer to the centre of curvature of the track parts 28 and 29 than are these track parts. The track portion 30 lies further from the centre of curvature than are the track parts 28 and 29. The separation between the track portions 30 and 31, measured along a line which passes through the centre of curvature of the track parts 28 and 29, is substantially equal to twice the radius of curvature of the track parts 28 and 29.

There is provided on the camshaft 18, at a position to lie within the aperture 27, a cam 32 having two contact portions, 33 and 34, at diammetrically opposite positions with respect to the cam axis 19. The extremeties of the contact portions 33 and 34 are each spaced from the axis 19 by a distance substantially equal to the radius of curvature of the track parts 28 and 29. Accordingly, contact portions 33 and 34 bear, at diammetrically opposite positions, on the track defined by the follower 25.

The contact portions 33 and 34 may be integral one with the other and engage in sliding contact with the cam track. Alternatively, the contact portions may be constituted by rollers which roll on the cam track. It will be understood that small clearances are provided so that one contact element may be just clear of the cam track when the other contact element is in firm contact with the cam track. Furthermore, there is sufficient clearance for the closing of the valve 16 to be completed by pressure within the combustion chamber acting on the head of the valve, without the cam 32 interfering with such movement of the valve. This ensures that the cam 32 does not prevent complete closing of the valve. It will be noted that, when the valve is closed, the contact portions 33 and 34 are engaged with the arcuate portions 28 and 29 of the track. When the cam 32 turns sufficiently to bring one of the contact portions 33, 34 into engagement with the portion 30 of the track and the other contact portion into engagement with the portion 31 of the track, the valve 16 is moved in a direction away from the cam axis 19 to lift the valve head off its seat and open the valve. As the cam is rotated further to move the contact portions off the track portions 30 and 31, the follower 25 is driven in a direction away from the cylinder 11 to move the valve to the closed position. It will be noted that no valve springs are provided and that the valve is moved positively in both the opening and closing direction.

The cam 32 and follower 25 have a small extent in a direction along the cam axis 19, for example dimensions in this direction within the range 4 to 8 millimeter. The follower may be formed entirely of metal or at least partly of a suitable plastics material, a suitable ceramic material or other non-metallic material, for example toughened zirconia. The follower may have a lining of relatively hard material which presents the cam track and a body of other material. Where a number of similar followers are provided in the engine, these may have substantially identical bodies but linings of somewhat different shape, which provide different opening and closing times for different valves.

A follower 35, which may be identical with or similar to the follower 25, is associated with the exhaust valve 17 and a cam 36, which may be identical with the cam 32, is provided for reciprocating the follower 35. These parts operate in the manner hereinbefore described with reference to the follower 25 and cam 32.

It will be seen from FIG. 1 that the operating means for the valves 16 and 17 is compact and enables the inlet duct 14 and the exhaust duct 15 to be routed near to the cam axis 19 so that these ducts are inclined at only small angles to the longitudinal axis of the cylinder 11. There are no rockers associated with the valves and accordingly space is not required to accommodate pivots for rockers. The followers 25 and 35 can have a low mass, as compared with the mass of rockers.

In the example illustrated, the contact portions 33 and 34 are identical and each is symmetrical about a plane which contains the cam axis 19. Alternatively, the contact portions may be asymmetrical about such a plane, being provided each with a leading edge which is of somewhat different form than is the trailing edge of the contact portions.

I claim:

1. An internal combustion engine having at least one valve which is guided for reciprocation along a rectilinear path and operating means for moving the valve in opposite directions along the path, wherein the operating means comprises a follower, guide means for guiding the follower for reciprocation along a rectilinear path which is an extension of the path along which the valve reciprocates, coupling means for coupling the follower with the valve, a non-circular, endless track formed in the follower and facing towards an axis (called herein the cam axis), which is transverse to the path of the follower and a cam supported for rotation around the cam axis and having a pair of opposite contact portions which run on the track and cause reciprocation of the follower relative to the cam axis when the cam rotates around the cam axis, the guide means restraining rotation of the follower around the cam axis wherein, when the follower is at one end of its path, said contact portions of the cam are spaced apart in a direction transverse to the length of said rectilinear path.

2. An engine according to claim 1 wherein the track formed in the follower includes two opposite portions which substantially define respective arcs of a common circle, which portions are spaced apart in a direction transverse to the length of said path and which portions are engaged by respective ones of the contact portions of the cam when the valve is held by the cam and follower in a closed position.

3. An engine according to claim 1 comprising a number of valves arranged for movement along respective paths which intersect the cam axis, each valve being inclined with respect to at least one other valve and each valve being provided with a respective follower defining an aperture through which there extends a camshaft provided with a number of cams, one for each follower.

4. An internal combustion engine having at least one valve which is guided for reciprocation along a rectilinear path and operating means for moving the valve in opposite directions along the path, wherein the operating means comprises a follower, guide means for guiding the follower for reciprocation along a rectilinear path which is an extension of the path along which the valve reciprocates, coupling means for coupling the follower with the valve, a non-circular, endless track formed in the follower and facing towards an axis (called herein the cam axis) which is transverse to the path of the follower and a cam supported for rotation around the cam axis and having a pair of contact portions which run on the track and cause reciprocation of the follower relative to the cam axis when the cam rotates around the cam axis, the guide means restraining rotation of the follower around the cam axis, wherein said contact portions lie at the same distance from the cam axis and in diametrically opposition positions with respect to the cam axis.

5. An engine according to claim 4 wherein said track includes two opposite, arcuate portions which substantially define respective arcs of a common circle and two further curved portions lying between said arcuate portions.

6. An internal combustion engine having at least one valve which is guided for reciprocation along a rectilinear path and operating means for moving the valve in opposite directions along the path, wherein the operating means comprises a follower, guide means for guiding the follower for reciprocation along a rectilinear path which is an extension of the path along which the valve reciprocates, coupling means for coupling the follower with the valve, a curved, non-circular, endless track formed in the follower and facing towards an axis (called herein the cam axis), which is transverse to the path of the follower and a cam supported for rotation around the cam axis and having a plurality of contact portions which run on the entire length of the track and cause reciprocation of the follower relative to the cam axis when the cam rotates around the cam axis, the guide means restraining rotation of the follower around the cam axis.

* * * * *